United States Patent [19]

Ducrocq et al.

[11] Patent Number: 5,074,532

[45] Date of Patent: Dec. 24, 1991

[54] ELECTRO-MAGNETIC NOZZLE DEVICE FOR CONTROLLING A STREAM OF LIQUID METAL TAPPED FROM A CRUCIBLE

[75] Inventors: Christian A. B. Ducrocq, Taverny; Marcel Garnier, Uriage; Pascal J. Rivat, Meylan; Maurita Roscini, Grenoble, all of France

[73] Assignee: Societe Nationale d'Etude et de Construction de Moteurs d'Aviation "S.N.E.C.M.A.", Paris, France

[21] Appl. No.: 550,491

[22] Filed: Jul. 10, 1990

[30] Foreign Application Priority Data

Jul. 12, 1989 [FR] France ..... 89 09369

[51] Int. Cl.[5] ..... C21C 5/42

[52] U.S. Cl. ..... 266/237; 222/594

[58] Field of Search ..... 222/590, 591, 594; 164/463; 266/237; 75/333

[56] References Cited

U.S. PATENT DOCUMENTS

| | | | |
|---|---|---|---|
| 4,572,279 | 2/1986 | Lewis et al. | 164/463 |
| 4,863,509 | 9/1989 | Metz | 75/333 |

FOREIGN PATENT DOCUMENTS

| | | |
|---|---|---|
| 0021889 | 1/1981 | European Pat. Off. . |
| 0153205 | 8/1985 | European Pat. Off. . |
| 0260617 | 3/1988 | European Pat. Off. . |
| 0345146 | 12/1989 | European Pat. Off. . |
| 2316026 | 1/1977 | France . |
| 2396612 | 2/1979 | France . |
| 2397251 | 2/1979 | France . |

*Primary Examiner*—S. Kastler

*Attorney, Agent, or Firm*—Oblon, Spivak, McClelland, Maier & Neustadt

[57] ABSTRACT

An electro-magnetic nozzle device for controlling the jet of liquid metal tapped at the outlet of a melting crucible comprises an electro-magnetic inductor and a magnetic field concentrator which surrounds the outlet of the crucible and is constituted by at least four three-dimensional sectors arranged evenly around the crucible outlet and separated from each other by radial slits, each sector having an internal water-cooled cavity, radially inner and outer walls of which the inner wall is of less height than the outer wall, and windings disposed in the inner and outer walls forming an electro-magnetic inductor.

4 Claims, 2 Drawing Sheets

ELECTRO-MAGNETIC NOZZLE DEVICE FOR CONTROLLING A STREAM OF LIQUID METAL TAPPED FROM A CRUCIBLE

BACKGROUND OF THE INVENTION

1. Field of the Invention

The present invention relates to an electro-magnetic nozzle device for use, in particular, at the outlet of a crucible to stabilize the tapping, at a variable flow rate, of a liquid metal in the form of ultra-clean material intended, in particular, for atomization to produce metallic powders such as for the manufacture of superalloy components for aeronautical applications.

The processes which are known and used at present for the production of superalloys, especially nickel-based superalloys such as those with which the invention is particularly concerned, involve melting operations in crucibles made of a ceramic type refractory material and performed under vacuum in a furnace. During such operations a metal/ceramic reaction occurs, which inevitably results in the presence of ceramic inclusions in the material obtained. A refining of the superalloy is accordingly necessary each time the conditions of use demand that a so-called super-clean superalloy should be obtained. This is particularly the case with nickel-based superalloys intended for aeronautical applications, such as components for gas turbine aero-engines or other propulsion units. Various known techniques are used to achieve such inclusion refining, e.g. by remelting in a cooled crucible, the melting being effected by electric arc, electron beam or plasma beam.

Whatever technique is used, however, when tapping the molten metal, whether to fill a mould or to atomize the liquid metal to obtain a powder, it becomes necessary either to swivel the furnace or to use a nozzle of refractory material at the outlet for the liquid metal. In the first case, controlling the rate of flow and the mass of the molten metal is virtually impossible, and, in the second case, although this problem is solved there are other drawbacks:

fairly large nozzle diameters are necessary so as to avoid the danger of clogging;

instability of the jet of liquid metal;

considerable difficulties in modifying the diameter of the liquid jet during operation.

Moreover, the contact between the liquid metal and the solid walls of the nozzle causes a double pollution of the metal:

firstly, a chemical pollution due to the reaction of liquid metal at high temperature with oxides contained in the refractory materials from which the walls are made; and secondly, a physical pollution due to abrasion of the nozzle walls by the flow of molten metal.

In particular applications of known techniques of processing liquid metals by atomization with gas these pollutions lead to the presence of numerous inclusions in the metal powders, and it is recognized that the presence of such inclusions in rotary parts of aero-engines may be the source of faults in the service life of these parts, which are subjected to oligocyclic fatigue stresses, leading particularly to premature breakage when subjected to high stresses at high temperatures. These Problems have led to reducing the grain size of the powders, resulting in very poor size grading efficiency in the production of these powders.

2. Summary of the Prior Art

Attempts at a solution have been proposed based on the use of an electromagnetic nozzle, which permits the jet of liquid metal to be confined without contact with the walls. For example, French Patents Nos. 2 316 026, 2 396 612 and 2 397 251 disclose electro-magnetic devices operating at high frequencies and in which a copper screen is required to obtain the desired confinement.

However, the industrial utilization of such devices, such as in a plant for the atomization production of nickel-based superalloy powders, presents considerable difficulties. French Patent No. 2 457 730 eliminates the copper screen, but since the device operates at low frequency it is necessary in numerous applications to call on high power rates, little compatible with industrialization, as soon as substantial reductions of the liquid metal jet become necessary, particularly in atomization powder production techniques.

SUMMARY OF THE INVENTION

It is an object of the invention to provide an electro-magnetic nozzle device which enables the drawbacks of the previously known devices to be avoided.

To this end, according to the invention, there is provided an electro-magnetic nozzle device for the outlet of a crucible for melting metal, said device comprising an electro-magnetic inductor having windings, and a magnetic field concentrator disposed between said inductor windings and said outlet of said crucible, said magnetic field concentrator surrounding said crucible outlet and being formed by at least four three-dimensional sectors evenly arranged around said crucible outlet and separated from each other by radial slits, each of said sectors having an internal water-cooled cavity, radially inner and outer walls, and windings disposed in said inner and outer walls forming an electro-magnetic inductor.

Preferably the radially inner and outer walls of each of said sectors are shaped as portions of coaxial vertical cylinders, said inner wall being of a lesser height than said outer wall, and said sectors each have planar upper and lower walls joining the upper and lower edges respectively of said radially inner and outer walls, and planar side walls joining the respective side edges of said inner and outer walls.

The remarkable results obtained are also conditioned by the choice of specific dimensional parameters as well as by determined parameters defining the applied magnetic field, particularly field intensity and frequency.

Other features and advantages of the invention will become apparent from the following description of embodiments of the invention with reference to the accompanying drawings.

DESCRIPTION OF THE PREFERRED EMBODIMENTS

Figure 1A:
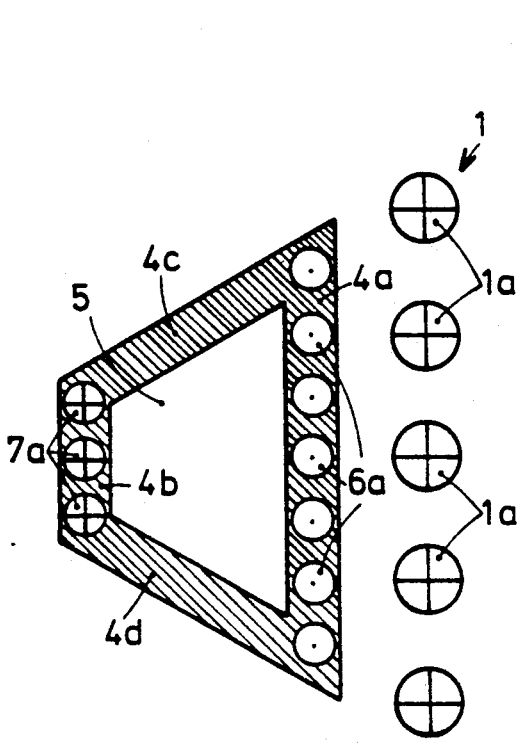
FIG. 1*a* shows a diagrammatic sectional view, in a vertical plane passing through the axis of symmetry, of half of one embodiment of an electro-magnetic nozzle device in accordance with the invention.
Figure 1B:
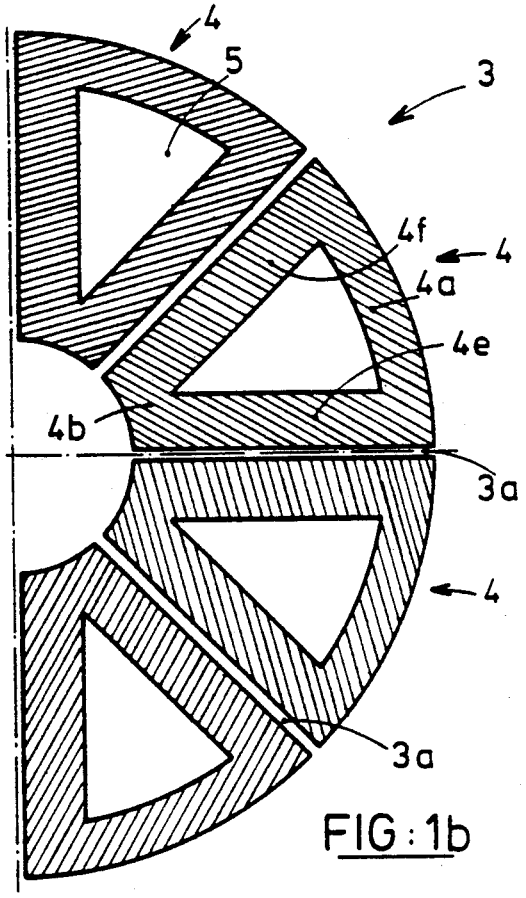
FIG. 1*b* shows a diagrammatic sectional view, in a horizontal plane, of half of the magnetic field concentrator of the electro-magnetic nozzle shown in FIG. 1*a*.
Figure 2:
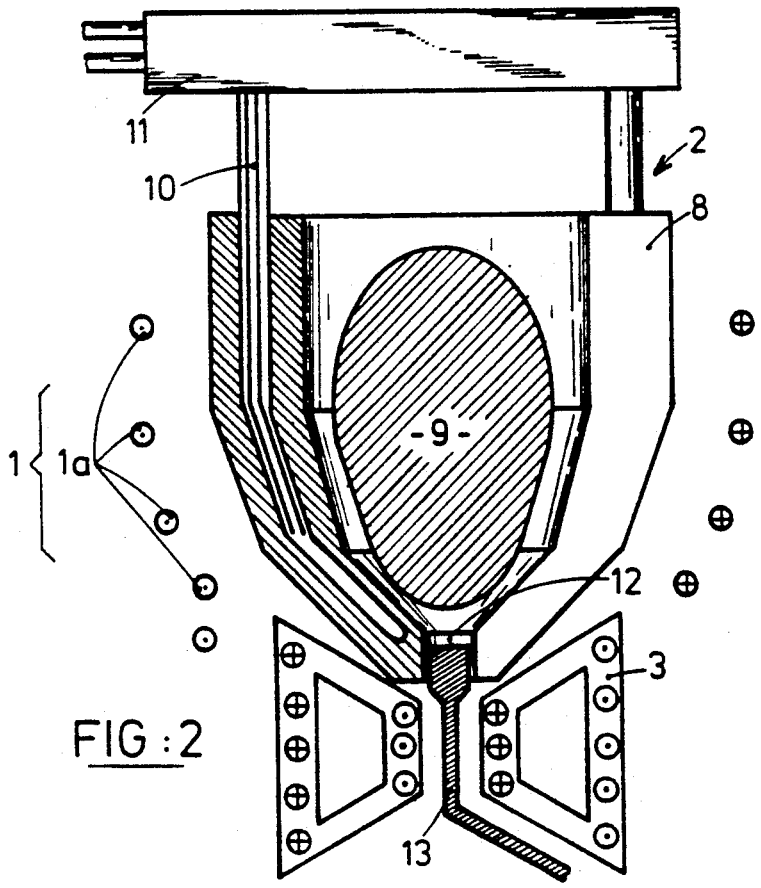
FIG. 2 shows a diagrammatic vertical sectional view through a cooled levitation crucible of known type fitted with the electro-magnetic nozzle device shown in FIGS. 1*a* and 1*b*.

FIGS. 1*a* and 1*b* show detail views of an electro-magnetic nozzle device constructed in accordance with the invention for use in controlling the jet of liquid metal at the crucible outlet in a molten metal casting installation such as partly shown in FIG. 2. The nozzle comprises an electro-magnetic inductor 1 of known type comprising several windings 1*a*. The implementation (supplies etc.) of the inductor 1 is also known and is therefore not shown. The inductor 1 is placed at the outlet of a crucible 2 and surrounds externally the walls of the crucible.

Between the inductor 1 and the walls of the crucible 2 there is a magnetic field concentrating device 3. This field concentrator 3 is sectorized, and the field concentration effect appears wherever a slit is present. To prevent deformation or deviation of the jet due to a higher magnetic field intensity facing a slit, the field concentrator 3 consists of an even number of identical sectors arranged symmetrically. To facilitate construction, and in the applications to the casting of metals or the atomization of superalloys, particularly nickel-based superalloys, envisaged by the invention, the number of sectors provided is preferably eight, although it may be reduced to four.

The particular construction and geometry of the sectors 4 of the field concentrator 3 of this embodiment of the invention is shown in FIGS. 1*a*, 1*b* and 2. Each sector 4 is constructed from copper plates and has a part-cylindrical radially outer wall 4*a* arranged vertically relative to the crucible 2, and a part-cylindrical radially inner wall 4*b* which is coaxial with the outer wall and is smaller in height. The four respective edges of the inner and outer walls 4*a* and 4*b* are joined by four planar wall portions, i.e. an upper wall 4*c*, a lower wall 4*d*, and side walls 4*e* and 4*f*. The inner cavity 5 thus formed inside each sector 4 is filled with cooling water. The part-cylindrical walls 4*a* and 4*b* have windings 6*a* and 7*a* so as to form an electro-magnetic inductor. The sectors 4 of the magnetic field concentrator 3 are separated by radial slits 3*a*.

The crucible 2 is of known type and has walls 8 the particular geometry of which permits the greater part of the liquid metal 9 to be maintained in levitation. The walls 8 have cooling tubes 10 supplied by a water box 11. The liquid metal is discharged at the outlet of the crucible 2 through an opening 12 closed by a cooled retractable finger 13.

Figure 3:
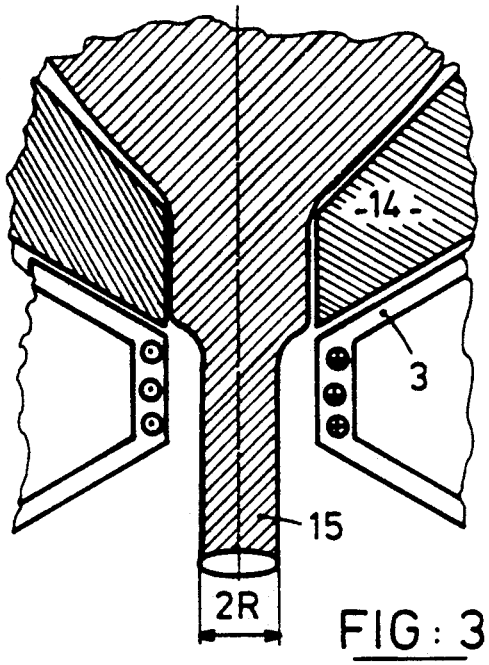
FIG. 3 shows a detail of FIG. 2 when a jet of liquid metal is being tapped from the crucible.

A detail of the lower part of the crucible 2, opened by retraction of the finger 13, is represented in FIG. 3 and shows the flow of a jet of liquid metal from the crucible. At the start, in the upper part of the crucible outlet, the jet of liquid metal has a diameter close to that of the passage 14 situated at the bottom of the crucible. As soon as the jet of liquid metal reaches the level of the magnetic field concentrator 3 of the electro-magnetic nozzle, the jet of metal experiences a reduction in cross-section 15.

Figure 4:
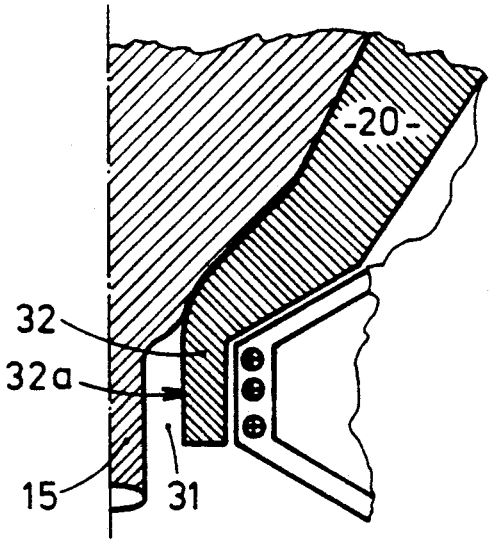
FIG. 4 is a view similar to that of FIG. 3 but showing the application of the electro-magnetic nozzle device in accordance with the invention to a standard refractory crucible.

If instead of a cold levitation crucible such as shown in FIGS. 2 and 3, a standard refractory crucible is used, for example for the atomization production of powders, the magnetic field concentrator 3 is located at the level of an opening 31 at the bottom part of the crucible 20 as diagrammatically shown in FIG. 4, bringing about a reduction in the cross section 15 of the tapped metal which removes the metal from contact with the wall 32*a* of the opening 31.

This result is achieved by virtue of the cration of an intensive magnetic field over a very localized area by the use of the electro-magnetic nozzle with magnetic field concentrator 3 in accordance with the invention. A standard coil inductor intended to achieve the same result would have a very considerable overall size incompatible with the constraints imposed by the control of the jet of liquid metal. In fact, by the choice of dimensional parameters and the suitable positioning of the electro-magnetic nozzle, particularly the magnetic field concentrator 3, for a particular application, axi-symmetrical forces directed towards the axis of the jet of liquid metal are generated. If the jet approaches the wall of the nozzle, the electro-magnetic nozzle creates a restoring force which recentres the jet on the axis of the nozzle. This restoring force requires an intensive magnetic field, the minimum frequency of which must be such that the depth of penetration of the magnetic field and of its induced currents in the jet is below radius R of the jet of liquid metal, this being expressed by the following relationship:

$$\mu\sigma WR^2 > 2$$

where $\mu$ is the magnetic permeability in vacuo:

$\sigma$ is the electric conductivity of the liquid metal;

R is the radius of the jet of liquid metal;

W is the pulsation of the magnetic field related to the frequency f by $W = 2\pi f$ The minimum frequency $f_l$ obtained is therefore:

$$f_1 = 1/\pi\mu\sigma R^2$$

The restoring force is obtained when the magnetic field generates an increasing force in the radial direction starting from the surface of the jet, which brings about, at a conservative rate of flow, a similar variation in the axial direction. Taking into account the exploitation of a pressure effect essentially of a surface nature, the effectiveness of the device increases with frequency. The increase of frequency also has the advantage of reducing the effects of liquid metal stirring. Practical limits, which can be determined experimentally for each application are, however, imposed upon the frequencies. A maximum frequency $f_2$ is thus established from the following criteria:

limitation of the power utilized;

risks of electrical arcing between the different sectors 4 of the magnetic field concentrator 3 or between the latter and the jet of metal;

increasing losses in the inductor 1 and the field concentrator 3 with increasing frequency;

effectiveness of the device as measured by the contraction coefficient X, expressed as a percentage and defined by:

$$X = (de - ds)/de$$

where de is the diameter of the liquid stream at the inlet of the nozzle, and ds is the diameter of the liquid stream at the outlet of the nozzle.

A frequency range f such that $$100\ \text{Hz} < f < 10^6\ \text{Hz}$$

is thus obtained in which the jet of liquid metal is not only channelled but also contracted.

The intensity B of the magnetic field applied is determined as a function of the magnetic pressure $P_m$ exerted at the periphery of the jet of liquid metal to balance the effects of surface voltage and the forces of inertia, and in the application concerned is found from the relationship:

$$Pm = B^2/2\mu$$

The application of these conditions to a sample of nickel-based superalloy remelted in the crucible 2 shown in FIGS. 2 and 3, in which the diameter of the actual nozzle 14 is 15 mm, has made it possible to obtain a diameter 2R of 6 mm for the liquid metal at the outlet of the electro-magnetic nozzle, i.e. a contraction coefficient X such as defined previously of 60%.

The following results are obtained, expressed as values of the contraction coefficient X as a function of the range of frequencies applied:

For $10^2$Hz$<f<10^6$Hz, $X>10\%$ for $f<10^2$Hz or $f>10^6$Hz, $X<10\%$ and for $5.10^3$Hz$<f<5.10^5$Hz, $X>50\%$.

The electro-magnetic nozzle device in accordance with the invention as just described thus ensures, by means of selecting the parameters of implementation adapted to each application according to the criteria which have been given, that the desired results are obtained, particularly the separation of the liquid metal from the walls of the remelting crucible, especially in the region of the actual outlet passage of the crucible, thus avoiding any contact between the walls and liquid metal and, as a result, any risk of pollution.

The device has, in addition, the advantage of ensuring stability of the contracted liquid metal jet over a substantial distance, and thus a laminar flow is obtained over a distance which may be in excess of ten times the outlet diameter of the electro-magnetic nozzle. Finally, the compactness of the device in accordance with the invention facilitates the setting up, at the outlet of the crucible, of an installation of the "superclean" type for remelting by electron beam, plasma beam or, as in the example described, for remelting in a cold crucible, of a casting installation (for a mould, for example) or an installation for the atomization production of powders.

We claim:

1. An electro-magnetic nozzle device for the outlet of a crucible for melting metal, said device comprising an electro-magnetic inductor having windings, and a magnetic field concentrator disposed between said inductor windings and said outlet of said crucible, said magnetic field concentrator surrounding said crucible outlet and being formed by at least four three- dimensional sectors evenly arranged around said crucible outlet and separated from each other by radial slits, each of said sectors having an internal water-cooled cavity, radially inner and outer walls, and windings disposed in said inner and outer walls forming an electro-magnetic inductor.

2. An electro-magnetic nozzle device according to claim 1, wherein said magnetic field concentrator comprises eight of said sectors.

3. An electromagnetic nozzle device according to claim 1, wherein said radially inner and outer walls of each of said sectors are shaped as portions of coaxial vertical cylinders, said inner wall being of a lesser height than said outer wall, and said sectors each have planar upper and lower walls joining the upper and lower edges respectively of said radially inner and outer walls, and planar side walls joining the respective side edges of said inner and outer walls.

4. An electro-magnetic nozzle device according to claim 3, wherein the walls of said sectors of said magnetic field concentrator are made of copper.

* * * * *

UNITED STATES PATENT AND TRADEMARK OFFICE

CERTIFICATE OF CORRECTION

PATENT NO. : 5,074,532

DATED : December 24, 1991

INVENTOR(S) : CHRISTIAN A.B. DUCROCQ ET AL

It is certified that error appears in the above-identified patent and that said Letters Patent is hereby corrected as shown below:

Column 1, line 66, change "Problems" to --problems--.

Column 4, line 5, change "cration" to --creation--;
line 19, change "recentres" to --recenters--;
line 35, change "$f_{\int}$" to --$f_1$--.

Signed and Sealed this

Twenty-second Day of June, 1993

*Attest:*

*Attesting Officer*

Michael K. Kirk

MICHAEL K. KIRK

*Acting Commissioner of Patents and Trademarks*